US007101189B1

(12) United States Patent
Huss et al.

(10) Patent No.: US 7,101,189 B1
(45) Date of Patent: Sep. 5, 2006

(54) ELECTRICAL CONNECTOR FOR AUTOMOTIVE WITH LATCH

(75) Inventors: John P. Huss, Harrisburg, PA (US); Michael McKee, Camp Hill, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/223,387

(22) Filed: Sep. 9, 2005

(51) Int. Cl.
*H01R 12/00* (2006.01)

(52) U.S. Cl. ..... 439/63; 439/581; 439/357

(58) Field of Classification Search ..... 439/63, 439/581, 582, 357, 947, 108
See application file for complete search history.

(56) References Cited

U.S. PATENT DOCUMENTS 5,326,280 A * 7/1994 Briones et al. ..... 439/581
6,386,888 B1 5/2002 Skopic et al.
6,776,621 B1 * 8/2004 Dye ..... 439/63
6,824,403 B1 11/2004 Hall et al.
2004/0157498 A1 8/2004 Hall et al.

* cited by examiner

*Primary Examiner*—Tho D. Ta
(74) *Attorney, Agent, or Firm*—Wei Te Chung

(57) ABSTRACT

An electrical connector (1) adapted for mating with a complementary connector includes a jack housing (10), a metal jack (20) and a contact (40). The metal jack is assembled with the jack housing, and includes a latching member (22) extending toward the jack housing along a front-to-back direction. The contact extends through the jack housing and the metal jack. The metal jack exerts a forward compressing force toward the jack housing when the latching member of the metal jack latches with the complementary connector.

19 Claims, 6 Drawing Sheets

ELECTRICAL CONNECTOR FOR AUTOMOTIVE WITH LATCH

BACKGROUND OF THE INVENTION

1. Field of the Invention

The present invention generally relates to an electrical connector, and more particularly to an electrical connector used in Automotive application.

2. Description of Prior Art

Cable to cable connectors and printed circuit board to cable connectors may be standardized according to various schemes. One standardization scheme commonly used in automotive applications is referred to as FAKRA. FAKRA, a standardization group, is a Germen word that stands for Normenausschuβ Kraftfahrzeuge with English translation known as "Automotive Standards Committee in the German Institute for Standardization." The FAKRA standardization scheme establishes how a jack housing must be configured in order to provide proper keying for integration into an appropriate plug, and at the same time allow for the connection of a desired SMB jack into the jack housing, which has the appropriate SMB interface.

Normally, the electrical connector with FAKRA standardization comprises a housing and a metal jack integrated with the housing. The housing defines a plastic latching member at the top face thereof, which is disclosed in U.S. Pat. No. 6,824,403. The electrical connector is used to electrically connect a complementary cable connector for transmitting signals from a cable to a printed circuit board, However, when the cable is of the complementary cable connector pulled unwilledly, the housing is tends to separate from the metal jack for lacking sufficient retaining force between the housing and the metal jack. When the unwilled pulling force is big enough, the housing with the latchmay be separated from the jack. For enhance the retaining force, the improved structure between the housing and metal jack is provided, but either the cost is too high or the structure is too complex.

Hence, it is desirable to have an improved electrical connector to overcome the above-mentioned disadvantages of the prior art.

BRIEF SUMMARY OF THE INVENTION

Accordingly, the object of the present invention is to provide an electrical connector allowing for greater loads placed thereon.

In order to achieve the above-mentioned object, an electrical connector adapted for mating with a complementary connector comprises a jack housing, a metal jack and a contact. The metal jack is assembled with the jack housing, and comprises a latching member extending toward the jack housing along a front-to-back direction. The contact extends through the jack housing and the metal jack. The metal jack exerts a forward compressing force toward the jack housing when the latch of metal jack latches with the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
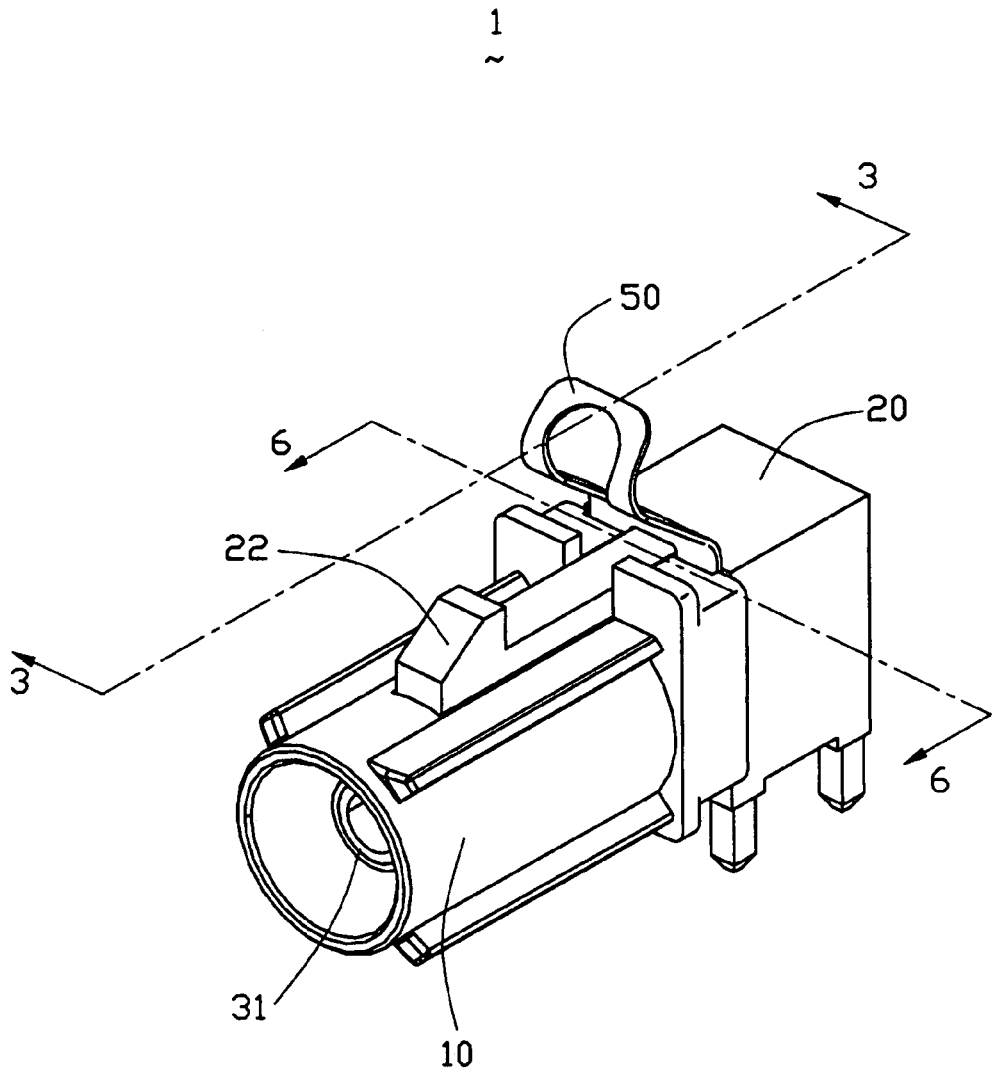
FIG. 1 is a perspective, assembled view of an electrical connector in accordance with the present invention.

Reference will now be made to the drawing figures to describe the present invention in detail.

Figure 2:
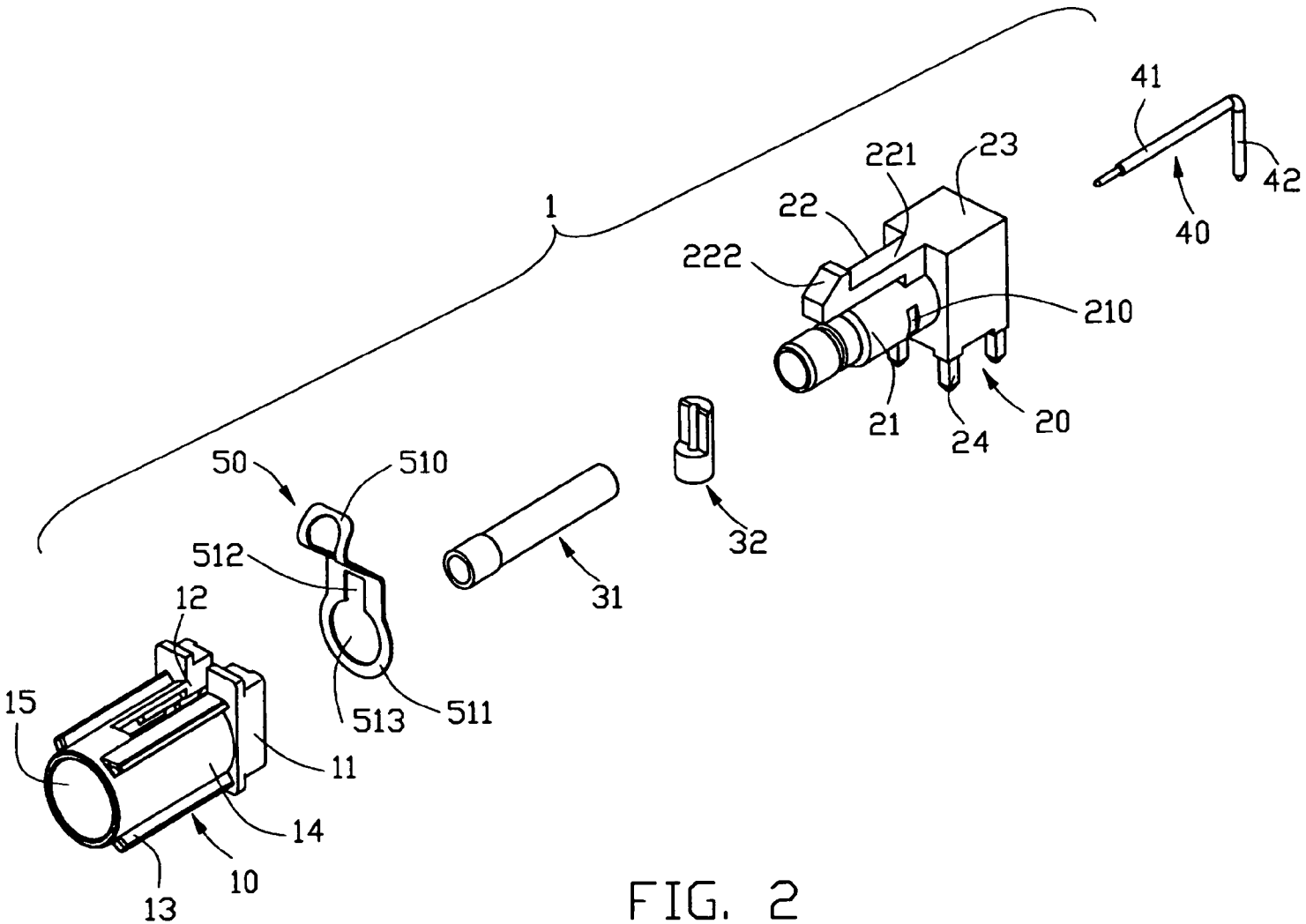
FIG. 2 is an exploded, perspective view of the electrical connector shown in FIG. 1.
Figure 3:
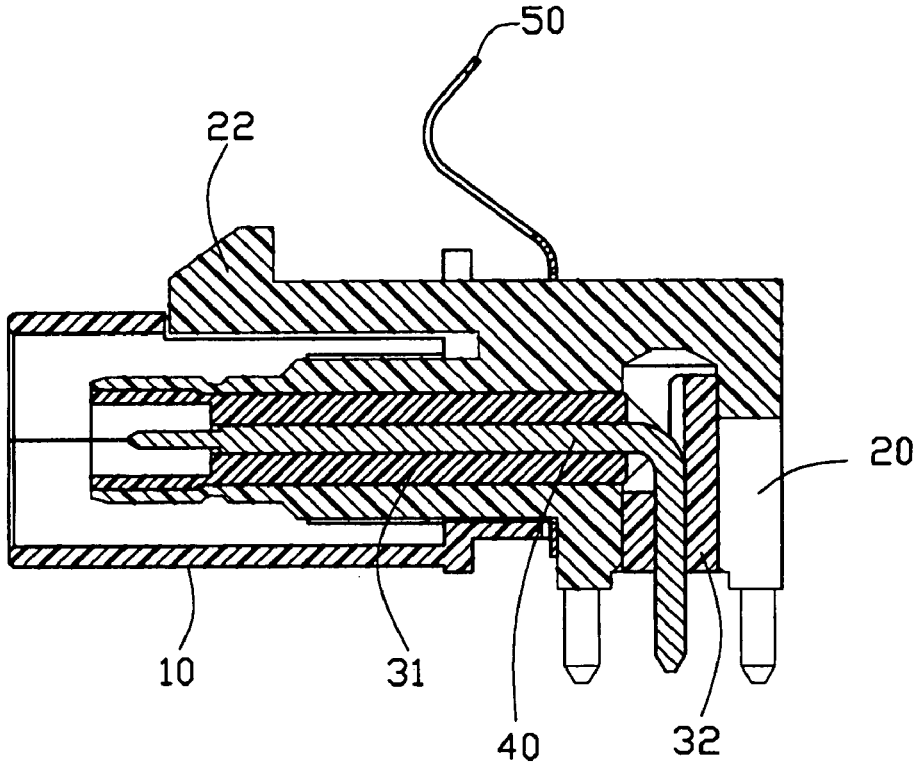
FIG. 3 is a cross-sectional view along the line 3—3 of the electrical connector shown in FIG. 1.
Figure 4:
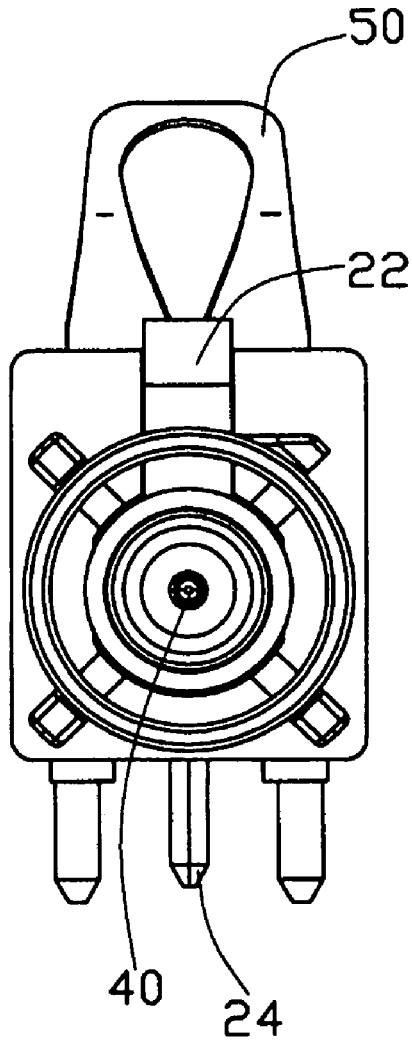
FIG. 4 is a front view of the electrical connector shown in FIG. 1.
Figure 5:
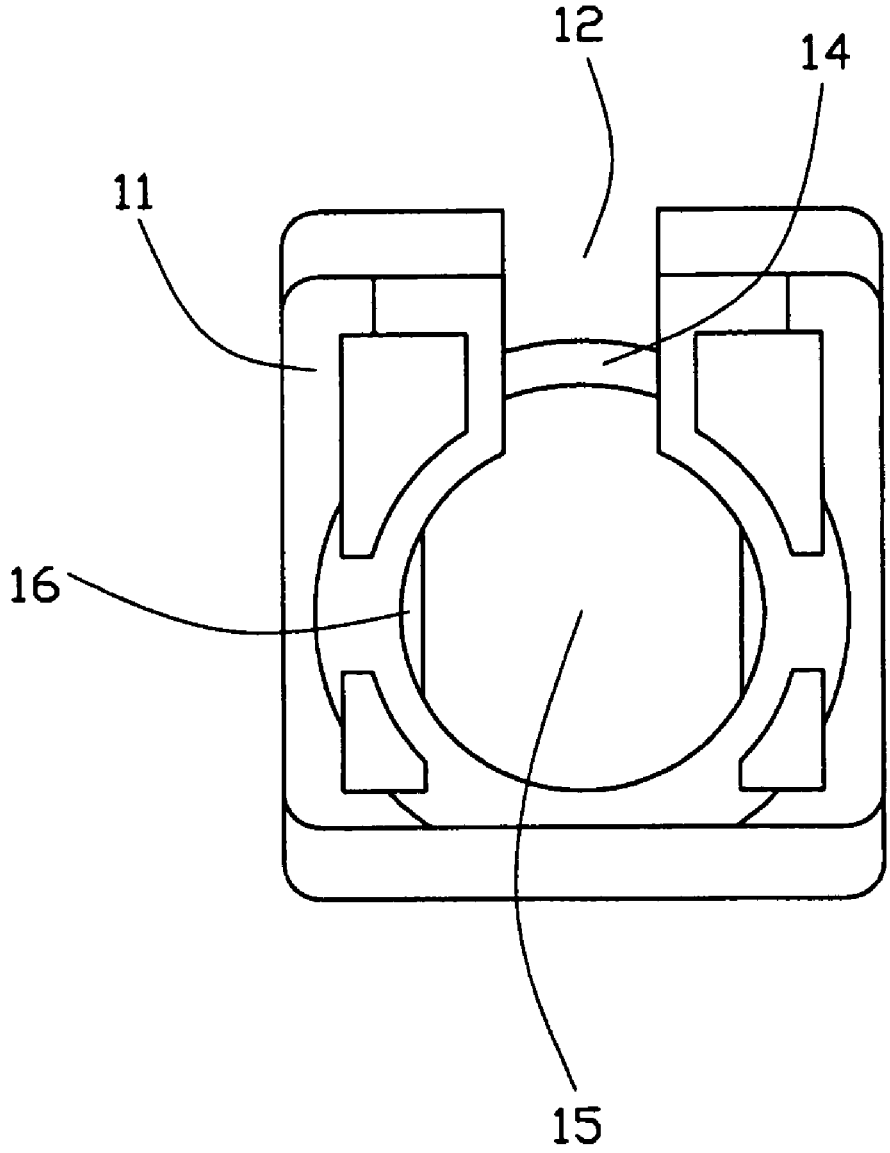
FIG. 5 is a rear view of a jack housing of the electrical connector.
Figure 6:
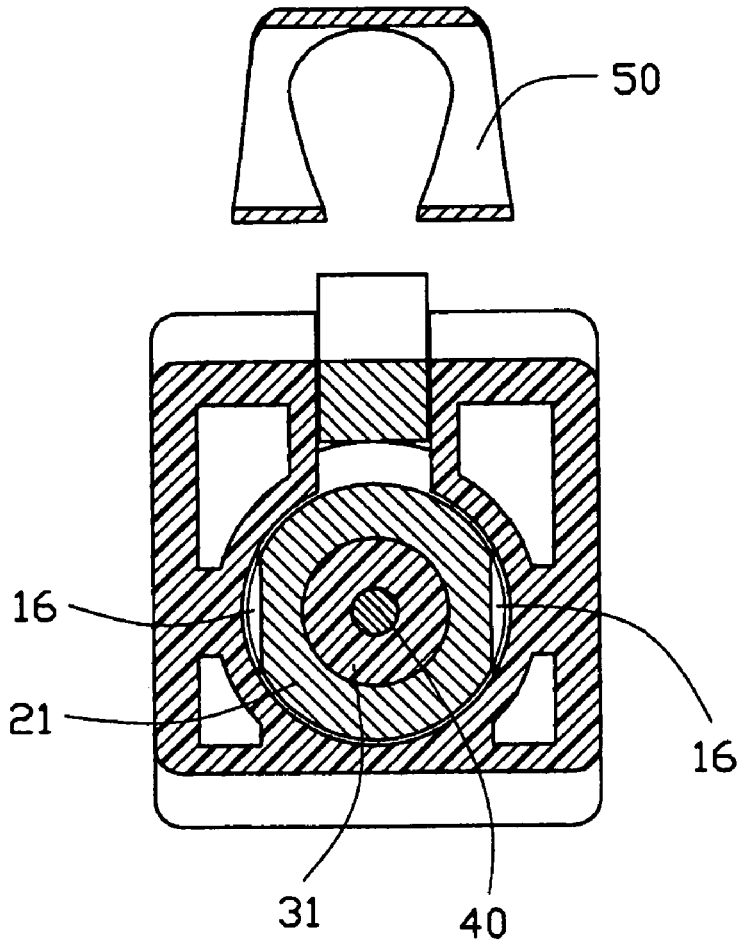
FIG. 6 is a cross-sectional view along the line 6—6 of the electrical connector shown in FIG. 1.

FIG. 1 to FIG. 3 show a preferred embodiment of the present invention, an electrical connector 1 comprises an insulative jack housing 10, a metal jack 20, a contact 40 and a grounding tab 50 sandwiched between the housing 10 and the metal jack 20. In the preferred embodiment of the present invention, the electrical connector 1 is complied with FAKRA standard.

Reference to FIG. 1 to FIG. 6, the jack housing 10 provides appropriate snap fit or other connection as is known in the art for a cable or other connector. In the especially preferred embodiments, the jack housing 10 is defined as appropriate according to the FAKRA standard, and comprises a base portion 11 and a column-shaped receiving portion 14 extending forwardly from the base portion 11. A receiving passageway 15 is defined in the jack housing 10 through the base portion 11 and the receiving portion 14 in a front-to-back direction. The receiving portion 14 defines a plurality of ribs 13 spaced arranged on the outer surface thereof and extending along the front-to-back direction. The jack housing 10 further defines a cutout 12 extending through the base portion 11 and receiving portion 14 at the top face thereof. The base portion 11 comprises a pair of blocks 16 (FIG. 5) on the inner surface thereof. The existence of the cutout 12 gives the jack housing 10 flexibility.

Turning now to FIGS. 2–3, a cross-sectional view of a preferred embodiment is shown. The metal jack 20 comprises a rectangular base 23, an annular projecting portion 21 extending forwardly from the base 23 and a latching member 22 extending forwardly from the base 23 and locating above the projecting portion 21. The latching member 22 comprises an arm 221 and a hook 222 at the distal end of the arm 221. Depending from metal jack 20 are legs 24 providing plug in mounting to the printed circuit board as is known in the art. Also seen is the pin-type contact 40 which provides the electrical connection from the printed circuit board also as known in the art. The contact 40 comprises a contacting portion 41 and a tail portion 42 extending downwardly from the contacting portion 41. The projecting portion 21 defines a pair of depressions 210. When the metal jack 20 is assembled on the jack housing 10, due to the existence of the cutout 12, the jack housing 10 may be more flexile to allow the blocks 16 received in the depressions 210 more easily.

The electrical connector 1 further comprises a first insulator 31 and a second insulator 32. The first insulator 31 encloses the contacting portion 41 received in the jack housing 10 and the metal jack 20. The second insulator 32 encloses the tail portion 42 received in the metal jack 20.

Back to FIG. 1 and FIG. 3, reference with FIG. 2, the first insulator 31 and the second insulator 32 enclose the contacting portion 41 and the tail portion 42, respectively. And then, the contact 40 passes through the metal jack 30, the grounding tab 50, and the jack housing 10, terminating in end. The grounding tab 50 comprises a spring portion 510 and a lower portion 511, the lower portion 511 comprises a hole, the hole is consists of a rectangular hole 512 and a circular hole 513. The latching member 22 and the projecting portion 21 respectively pass through the circular hole 513 and the rectangular hole 512 the lower portion 511 of the grounding tab 50, and the latching member 22 received in the cutout 12 of the housing 10. The spring portion 510 electrically connects with a chassis to which the electrical connector is mounted for grounding. The ribs 13 on the jack housing 10 may be disposed on the outer surface of jack housing 10 with different angles have different shape functioning as keying system adapted for mating with different corresponding connector.

The various elements are made of materials such as are known in the art. For example the jack housing 10 may be made of various plastics, such as Teflon, polypropylene, and polymethylpentene. A metal jack 20 is also constructed from suitable material as is known in the art, such a diecast zinc or similar materials. Grounding tab may be constructed of suitable grounding material as known in the art.

The latching member 22 on the metal jack 20 may allow for greater loads because of the metal material thereof, and simplifies the structure of the electrical connector and enhances the retaining force between the metal jack and jack housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mating with a complementary connector, comprising;

a jack housing with a cutout;

a metal jack assembled with the jack housing and comprising a latching member extending toward the jack housing along a front-to-back direction into the cutout of the jack housing;

a contact assembled to the jack housing and the metal jack;

wherein the metal jack exerts a forward compressing force toward the jack housing when the latching member of metal jack latches with the complementary connector along said front-to-back direction.

2. The electrical connector as claimed in claim 1, wherein the latching member is integrally formed with the metal jack.

3. The electrical connector as claimed in claim 1, wherein the latching member is made by metal material.

4. The electrical connector as claimed in claim 1, wherein the jack housing is made by insulative material.

5. The electrical connector as claimed in claim 1, further comprising a grounding tab located between the jack housing and the metal jack.

6. The electrical connector as claimed in claim 1, wherein the jack housing comprises a plurality of ribs on the outer surface thereof.

7. The electrical connector as claimed in claim 1, wherein the metal jack comprises a plurality of legs downwardly extending therefrom for providing plug in mounting to the printed circuit board.

8. The electrical connector as claimed in claim 1, further comprising a grounding tab, and wherein the grounding tab is a thin piece located between the jack housing and the metal jack, and has a spring portion electrically connecting with a chassis for grounding.

9. The electrical connector as claimed in claim 1, wherein the contact is a pin-type and assembled to the jack housing and the metal jack.

10. The electrical connector as claimed in claim 9, wherein the contact comprises a contacting portion and a tail portion extending downwardly from the contacting portion, and wherein the electrical connector comprises a first insulator and a second insulator respectively receiving the contacting portion and the tail portion.

11. The electrical connector as claimed in claim 1, wherein the housing jack comprises a block, and the metal jack comprises a depression receiving said block on the jack housing due to the flexing housing.

12. The electrical connector as claimed in claim 11, wherein the metal jack comprises a base and a projecting portion extending from the base, and wherein the latching member extends from the base, and is located above the projecting portion.

13. The electrical connector as claimed in claim 12, wherein a depression is defined in the projecting portion.

14. An electrical connector adapted for mating with a complementary connector mounted on a chassis, comprising:

a jack housing;

a metal jack assembled with the jack housing and comprising a base portion, a projecting portion extending into the jack housing and a latch member formed on the metal jack for latching with the complementary connector;

a contact assembled to the jack housing and the metal jack; and a grounding tab located between the jack housing and the metal jack for elastically connecting with the chassis on which the complementary connector is mounted.

15. The electrical connector as claimed in claim 14, wherein the grounding tab is flat.

16. An electrical connector adapted for mating with a complementary connector, comprising:

an insulative housing jack housing defining a tubular mating section;

a metal jack assembled with the jack housing and comprising a tubular projection received within an interior of said tubular mating section, and a latching member extending along a front-to-back direction and exposed adjacent to an exterior surface of said tubular mating section; and a contact having a contact section extending into an interior of said tubular projection; wherein an insulator is circumferentially located between the contact section and the tubular projection.

17. The connector as claimed in claim 16, wherein a grounding tab is sandwiched between the metal jack and the insulative jack housing in the front-to-back direction.

18. The connector as claimed in claim 16, wherein a grounding tab defines an opening receiving said tubular projection and said latch member therein.

19. The connector as claimed in claim 16, wherein said tubular mating section defines a slot extending through an upper face thereof to receive said latch member therein.

* * * * *